US006778004B1

(12) United States Patent
Jackson

(10) Patent No.: US 6,778,004 B1
(45) Date of Patent: Aug. 17, 2004

(54) DECOUPLING CAPACITOR MULTIPLIER

(75) Inventor: Scott A. Jackson, Starkville, MS (US)

(73) Assignee: Cypress Semiconductor Corporation, San Jose, CA (US)

( * ) Notice: Subject to any disclaimer, the term of this patent is extended or adjusted under 35 U.S.C. 154(b) by 0 days.

(21) Appl. No.: 10/326,485

(22) Filed: Dec. 20, 2002

(51) Int. Cl.[7] ..... G05F 1/10
(52) U.S. Cl. ..... 327/538
(58) Field of Search ..... 327/530, 534, 327/535, 538, 543

(56) References Cited

U.S. PATENT DOCUMENTS 5,057,792 A 10/1991 Gay
5,079,518 A 1/1992 Wakayama
5,650,746 A 7/1997 Soltau
6,344,772 B1 * 2/2002 Larsson ..... 327/552
6,377,126 B1 4/2002 Guedon

OTHER PUBLICATIONS

Gabriel A. Rincon–Mora, "Active Capacitor Multiplier in Miller–Compensated Circuits", Jan. 2000, pp. 26–32, vol. 35, No. 1, IEEE Transactions; Texas Instruments, Inc. Dallas, TX.
"decoupling in digital circuits", elektor Nov. 1983.

* cited by examiner

*Primary Examiner*—Jeffrey Zweizig
(74) *Attorney, Agent, or Firm*—Okamoto & Benedicto LLP

(57) ABSTRACT

A decoupling circuit comprising a first capacitor, and a first current mirror coupled to the capacitor, wherein the first current mirror is configured to multiply the capacitance effect of the first capacitor is disclosed. The first current mirror may comprise a first transistor, and a second transistor coupled to the first transistor, wherein the second transistor is configured to amplify the current entering the first transistor. The first transistor and the second transistor may comprise n-channel MOSFET transistors. The decoupling circuit may further comprise a bias network coupled to the first current mirror, wherein the bias network is configured to bias the first current mirror. The bias network may comprise a p-channel MOSFET.

16 Claims, 4 Drawing Sheets

DECOUPLING CAPACITOR MULTIPLIER

BACKGROUND OF THE INVENTION

1. Field Of The Invention

The present invention relates generally to filtering signal noise in integrated circuits, and more particularly to a decoupling capacitor multiplier circuit.

2. Description Of The Background Art

Integrated circuits (hereafter "ICs") may be typically designed as direct current (DC) circuits. The component devices constituting the IC operate within predetermined voltage thresholds, and therefore may fail when random electrical fluctuations cause operating thresholds to be exceeded. IC circuits are subject to numerous sources of random electrical fluctuations, including fluctuations caused by switching devices and naturally occurring noise from a DC power source. For practical purposes, the aforementioned electrical fluctuations are functionally equivalent to alternating currents (AC), and are hereafter referred to as the AC components in the DC signals.

As a result of the potential for device failure caused by excessive AC components in the DC signals, decoupling capacitors are typically used to filter out or dampen the AC components. FIG. 1A schematically illustrates a common use of the decoupling capacitor for filtering AC components from an input signal $V_d$ 2. In FIG. 1A, passive decoupling capacitor 6 is connected directly to the input signal $V_d$ 2 and to the ground (VGND) 8. This simple connection allows the AC component of the input signal $V_d$ 2 to pass through to ground 6. A frequency domain analysis of FIG. 1A yields an admittance of: id/vd=$s_{Cd}$. As is evident from the frequency domain analysis, the admittance as seen by input signal $V_d$ is proportional to the capacitance of decoupling capacitor $C_d$.

In operation, the decoupling capacitor $C_d$ 6 acts like a reserve of current smoothing out the "dips" and "peaks" in the DC input signal $V_d$ 2. The charged decoupling capacitor $C_d$ 6 helps to fill in any dips in the input signal $V_d$ voltage by releasing its charge when the voltage drops, or by storing charge when the voltage peaks. The size of the decoupling capacitor $C_d$ 6 determines how big of a dip it can fill, or how big of a peak it can smooth out. The larger the decoupling capacitor 6, the larger the dip and peaks it can handle. Large loads delivered by power sources often require a very large capacitance for effective decoupling.

FIG. 1B schematically illustrates a conventional decoupling scheme for a power source. In practice, because a power source may require a large capacitance for proper decoupling, the required capacitance is often achieved by using a number of smaller capacitors 10N connected in parallel. Typically only a portion of the required decoupling capacitors are integrated on the chip die because they require too much costly chip die real estate. Accordingly, in some cases, the decoupling capacitors are implemented as separate components from the IC and connected to the IC via the printed circuit board ("PCB"). A drawback to this technique, however, is the added PCB space required to accommodate the decoupling capacitors, and therefore the added increase to the overall size of the electronic device.

SUMMARY

A decoupling circuit comprising a first capacitor, and a first current mirror coupled to the capacitor, wherein the first current mirror is configured to multiply the capacitance effect of the first capacitor is disclosed. The first current mirror may comprise a first transistor and a second transistor coupled to the first transistor. The first transistor and the second transistor may comprise n-channel MOSFET transistors. The decoupling circuit may further comprise, a bias network coupled to the first current mirror, wherein the bias network is configured to bias the first current mirror. The bias network may comprise a p-channel MOSFET.

In another aspect of the invention, the decoupling circuit additionally comprises a second capacitor, and a second current mirror coupled to the capacitor, wherein the second current mirror is configured to multiply the capacitance effect of the second capacitor. An input node may be connected to the first current mirror and the first capacitor, and the second current mirror and the second capacitor, wherein the input node is configured to receive an input signal in a first polarity and a second polarity opposite to the first polarity. Depending on the polarity of the input signal, the input signal is decoupled by either the first current mirror and the first capacitor, or the second current mirror and the second capacitor.

These and other features and advantages of the present invention will be readily apparent to persons of ordinary skill in the art upon reading the entirety of this disclosure, which includes the accompanying drawings and claims.

The use of the same reference label in different drawings indicates the same or like components. Unless otherwise noted, the figures are not drawn to scale.

DETAILED DESCRIPTION

In the present disclosure, numerous specific details are provided, such as examples of apparatus, components, and methods to provide a thorough understanding of the embodiments of the invention. Persons of ordinary skill in the art will recognize, however, that the invention can be practiced without one or more of the specific details, or with other apparatus, components, and methods. In some instances, well-known details are not shown or described to avoid obscuring aspects of the invention.

The demand for more highly integrated electronic devices is continually increasing. This is driven in part by the increasing demand for more compact mobile computing devices, for example, mobile telecommunication devices.

Disclosed herein is a decoupling capacitor circuit (hereafter "decoupling circuit") which includes a decoupling capacitor (hereafter "capacitor") and a circuit, wherein the circuit generates a decoupling effect equivalent to a multiple of the capacitance of the capacitor. For purposes of this disclosure, the "capacitance effect" of the decoupling circuit is the ability of the decoupling circuit to electrically operate as a decoupling capacitor in reference to a given input signal. The decoupling circuit of the present invention—comprising active components in addition to a passive decoupling capacitor—is advantageously implemented in a smaller chip die area than an equivalent implementation using solely passive elements, e.g., a capacitor. This savings in chip die real estate directly translates into cost savings in the production of ICs and their incorporation into electronic devices.

Figure 1A:
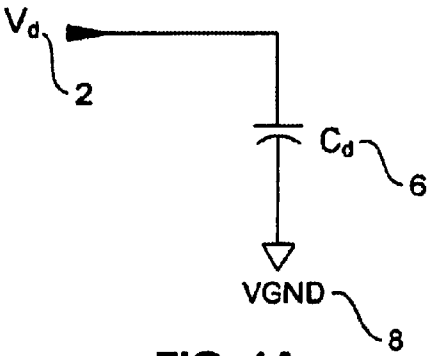
FIG. 1A (PRIOR ART)
FIGS. 1A–1B schematically illustrate conventional uses of a decoupling capacitor.
Figure 1B:
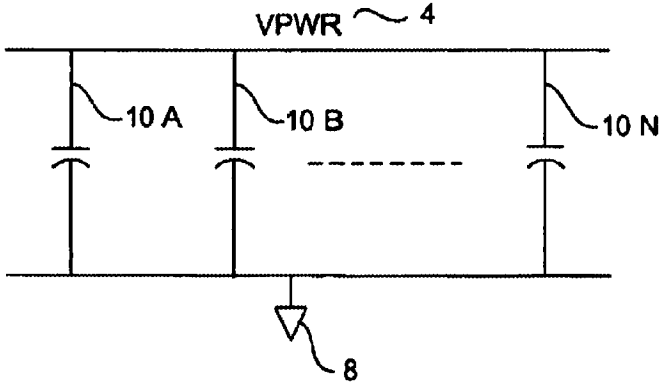
FIG. 1B (PRIOR ART)
Figure 2:
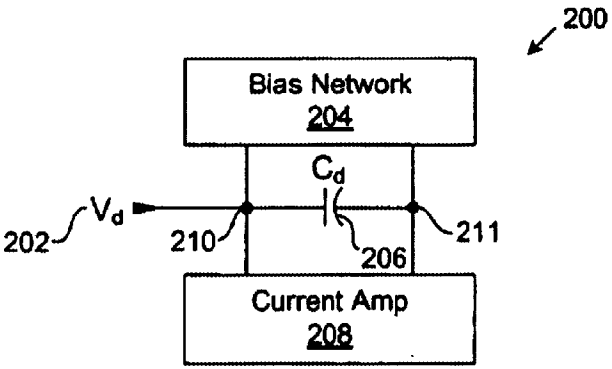
FIG. 2 schematically illustrates a decoupling circuit, according to an embodiment of the present invention.

FIG. 2 schematically illustrates a decoupling circuit, according to an embodiment of the present invention. In FIG. 2, a decoupling circuit 200 includes a signal $V_d$ 202 to be decoupled (hereafter "input signal"), nodes 210 (hereafter "input node") and 211, a capacitor $C_d$ 206, a bias network 204, and a current amplifier 208. In some embodiments of the present invention, current amplifier 208 comprises a conventional current mirror. Bias network 204 supplies a biasing signal for maintaining current amplifier 208 in a proper operating region. In some embodiments, bias network 204 may include one or more transistors and a power source. In other embodiments, the input signal $V_d$ 202 may simultaneously operate as the biasing signal thereby enabling bias network 204 to be omitted. Current amplifier 208 amplifies the current passing into input node 210 as a multiple of the current passing into node 211. Input signal $V_d$ 202 is connected to the decoupling circuit 200 at input node 210.

In operation, the current amplifier 208 and the capacitor 206 form a negative feedback loop with the input $V_d$ signal 202. Input signal $V_d$ 202 causes a small-signal current to pass through capacitor $C_d$ 206. The small-signal current then enters current amplifier 208, and current amplifier 208 then generates an amplified current at input node 210 as a function of the small-signal current. The decoupling capacitance effect on the input signal $V_d$ 202 caused by the current amplification at node 210 represents a multiplication of the normal decoupling capacitance of passive capacitor element $C_d$ 206. The resulting amount of decoupling effect is a function of the amount of current amplification generated by current amplifier 208 and the size of the capacitor $C_d$ 206, as explained in greater detail in reference to FIGS. 34.

Figure 3:
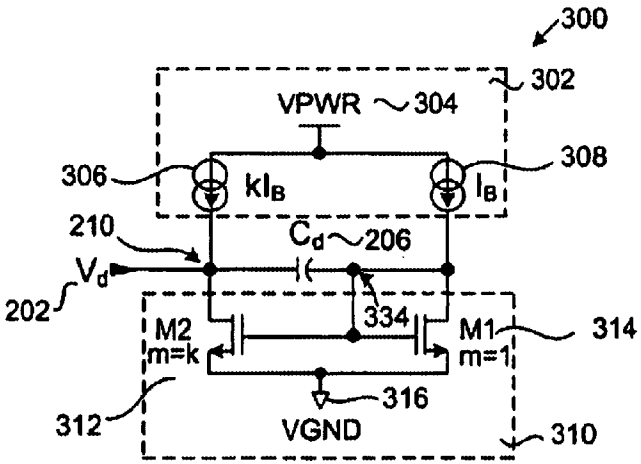
FIG. 3 schematically illustrates an implementation of the decoupling capacitor multiplier of FIG. 2, according to one embodiment of the present invention.

FIG. 3 schematically illustrates an implementation of the decoupling capacitor multiplier of FIG. 2, according to one embodiment of the present invention. In FIG. 3, current amplifier 208 (FIG. 2) is implemented with a current mirror 310. In some embodiments, current mirror 310 includes a first transistor M1 314, a second transistor M2 312, and a ground 316. In some embodiments, first transistor M1 314 and second transistor M2 312 comprise n-channel MOSFET transistors. As illustrated in FIG. 3, first transistor M1 314 and second transistor M2 312 have their gates and sources connected together with the sources in turn connected to ground 316; therefore, first transistor M1 314 and second transistor M2 312 share the same voltage from gate to source. In addition, first transistor M1 314 is connected as a diode to current source 308 by shorting its gate to its drain. Current source 308 supplies a constant current $l_b$ to diode-connected first transistor M1 314 thereby establishing a voltage across first transistor M1 314 that corresponds to the value of current $l_b$. This voltage is mirrored in second transistor M2 312 from gate to source. However, due to the larger geometry of the second transistor M2 312 relative to the first transistor M1 314, an amplified current ($kl_b$) is mirrored at the drain of the second transistor M2 312 which represents a multiple k of the current ($l_b$) flowing into the drain of the first transistor M1 314. The current generated by current mirror 310 into the drain of second transistor M2 312 is therefore a multiple k of the current ($l_b$) entering the drain of first transistor M1 314.

In operation, first current source 308 supplies a current $l_B$ for biasing transistor M1 314 into the desired operating region. A second current source 306 supplies a larger current $kl_b$ for biasing the geometrically larger second transistor M2 312. The larger biasing current ($kl_b$) is a multiple of k to match the current gain introduced by the current mirror 310. Decoupling circuit 300 receives input signal $V_d$ 202 at input node 210. Input node 210 is connected to capacitor $C_d$ 206, and to the drain of the second transistor M2 312. The DC pull-down from the second current source 306 is correctly balanced with the DC pull-up at the drain of transistor M2 312, so that the input signal $V_d$ 202 at input node 210 does not see a DC load at the input node 210. Accordingly, when input signal $V_d$ 202 enters node 210, it flows through capacitor $C_d$ as small-signal current $i_c$. If a low impedance is assumed at node 334 (on the output side of capacitor $C_d$ 206), then the small-signal current ic across the capacitor $C_d$ 206 is approximately:

$$i_c = sC_d v_d.$$

Small-signal current $i_c$ is then added to biasing signal $l_B$ entering the drain of transistor M1 314 in current mirror 310. Current mirror 310 then amplifies small-signal current $i_c$ by current gain k caused by the geometry differences between the first and second transistors M2 312 and M1 314 respectively. Accordingly, the total current into input node 210 is approximately:

$$i_d = i_c + ki_c = i_c(l+k).$$

After substituting for $i_c$ (as given in the preceding equation) and re-arranging terms, the current $l_d$ into input node 210 as seen by input signal $V_d$ 202 is approximately:

$$i_d = s(l+k)C_d 19\ v_d.$$

The admittance (measured as current over voltage) looking into node 210 is then approximately:

$$\frac{i_d}{V_d} = s(1+k)C_d.$$

A comparison of the admittance equations for a conventional passive decoupling capacitor design $$\left(\frac{i_d}{V_d} = sC_d\right)$$

and embodiments of the active decoupling capacitor circuit comprising the present invention show the decoupling circuit 300 to yield a greater capacitance effect by a factor of approximately 1+k. Therefore, a 10 pF conventional (passive) decoupling capacitor—occupying a relatively large and valuable chip die area—may be replaced by an active decoupling capacitor circuit having a significantly smaller capacitor $C_d$ 206 of 0.91 pF, coupled to a current amplifier 310 of current gain (k) equal to 10 (i.e., 10 pF=(1+10)0.91 pH). Because a 0.91 pF capacitor with the attendant active decoupling circuit elements (e.g., current mirror 310 and biasing network 302) occupies a significantly smaller chip die area than a single 10 pF capacitor, chips using decoupling circuit 300 in accordance with this invention may be produced in smaller sizes and lower cost.

Figure 4:
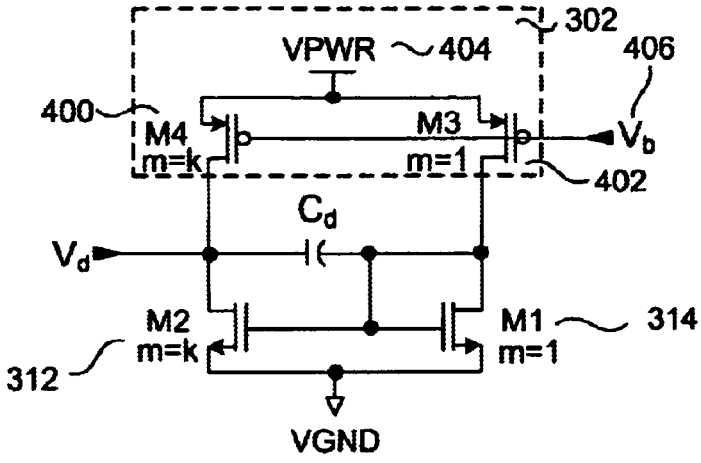
FIG. 4 schematically illustrates an implementation of a bias network for the decoupling circuit of FIG. 3, according to one embodiment of the present invention.

FIG. 4 schematically illustrates an implementation of a bias network 302 for the decoupling circuit of FIG. 3, according to one embodiment of the present invention. In FIG. 4, bias network 302 includes a first transistor M3 402, a second transistor M4 400, a power source 404, and a biasing signal $V_b$ 406. In some embodiments of the present invention, bias network 302 comprises p-channel MOSFET transistors. As illustrated in FIG. 4, the gates of each transistor M3 402 and M4 400 are connected to biasing signal $V_b$ 406, and the sources of each transistor (p-channel MOSFETs) M3 402 and M4 400 are connected to power supply 404. The drains of each transistor M3 402 and M4 400 are coupled at the drains of each transistor M1 314 and M2 312 respectively.

In operation, bias signal $V_b$ 406 biases transistors M3 402 and M4 400 into the proper operation region allowing current to flow from power source 404 through source. to drain in each transistor M3 402 and M4 400. Current draining from each transistor M3 402 and M4 400 is then used to bias transistors M1 314 and M2 312 in current mirror 310 to the proper operating region. The relative geometries of transistors M3 402 and M4 400 enable transistor M4 400 to drain a current which is a multiple of k larger than the current draining from M3 402. In particular, transistors M3 402 and M4 400 are configured to enable corresponding transistors M1 314 and M2 312 in current mirror 310 to pull current $l_b$ and $kl_b$ (reflecting the current gain k added by current mirror 310) into their drains respectively.

Figure 5:
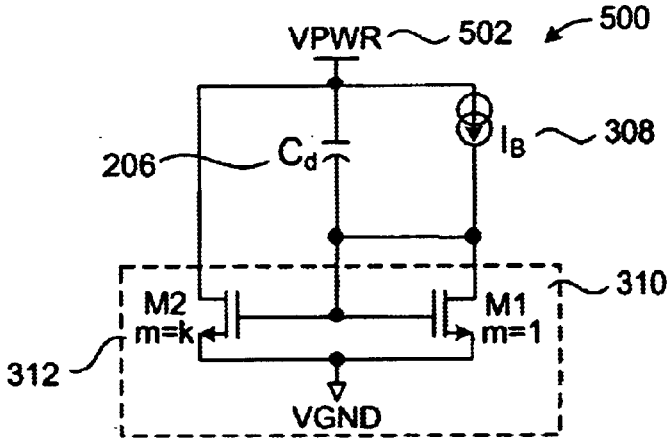
FIG. 5 schematically illustrates a decoupling circuit used to decouple a power supply, according to one embodiment of the present invention.

FIG. 5 schematically illustrates a decoupling circuit used to decouple a power supply, according to one embodiment of the present invention. In FIG. 5, decoupling circuit 500 corresponds in structure to the implementations described in reference to FIGS. 2-4, except that current source 306 (FIG. 3) and input signal $V_d$ 202 (FIG. 3) are omitted, thereby providing a direct connection between the power supply 502 and both the input of capacitor $C_d$ 206 and the source of transistor M2 312 in current mirror 310. In decoupling circuit 500, current source 306 (FIG. 3) may be omitted because the mirroring action of transistor M2 312 in current mirror 310 will force the correct current to be pulled from the power source 502. Current source 308 is still required for biasing current mirror 310, because the gate to transistor M1 314 should not be connected directly to the power supply 502. Direct connection of transistor M1 314 gate to the power supply 502 would cause an exact current to be setup dependent on the voltage of the power supply 502; this voltage would be too large and cause $C_d$ 206 to short out.

Figure 6:
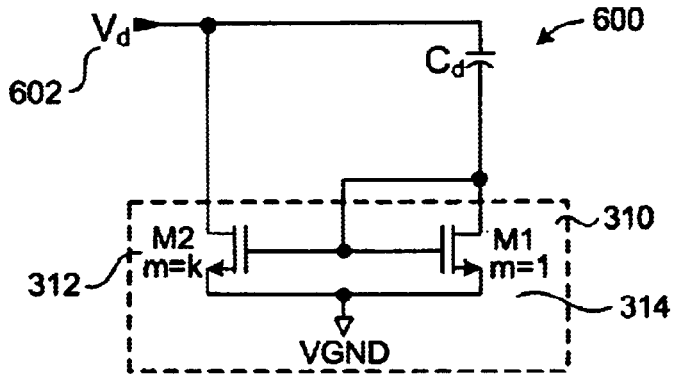
FIG. 6 schematically illustrates a zero-bias decoupling circuit, according to one embodiment of the present invention.

FIG. 6 schematically illustrates a zero-bias decoupling circuit, according to some embodiments of the present invention. In zero-bias decoupling circuit 600, a bias network, e.g., 302 in FIG. 3, and a power supply, e.g., 304 in FIG. 3, for the bias network are omitted, because current mirror 310 is directly biased by the input signal $V_d$ 602. Accordingly, zero-bias decoupling circuit 600 requires large excursions and a low threshold voltage in order for input signal $V_d$ 502 to properly bias transistors M2 312 and M1 314 in current mirror 310.

Figure 7:
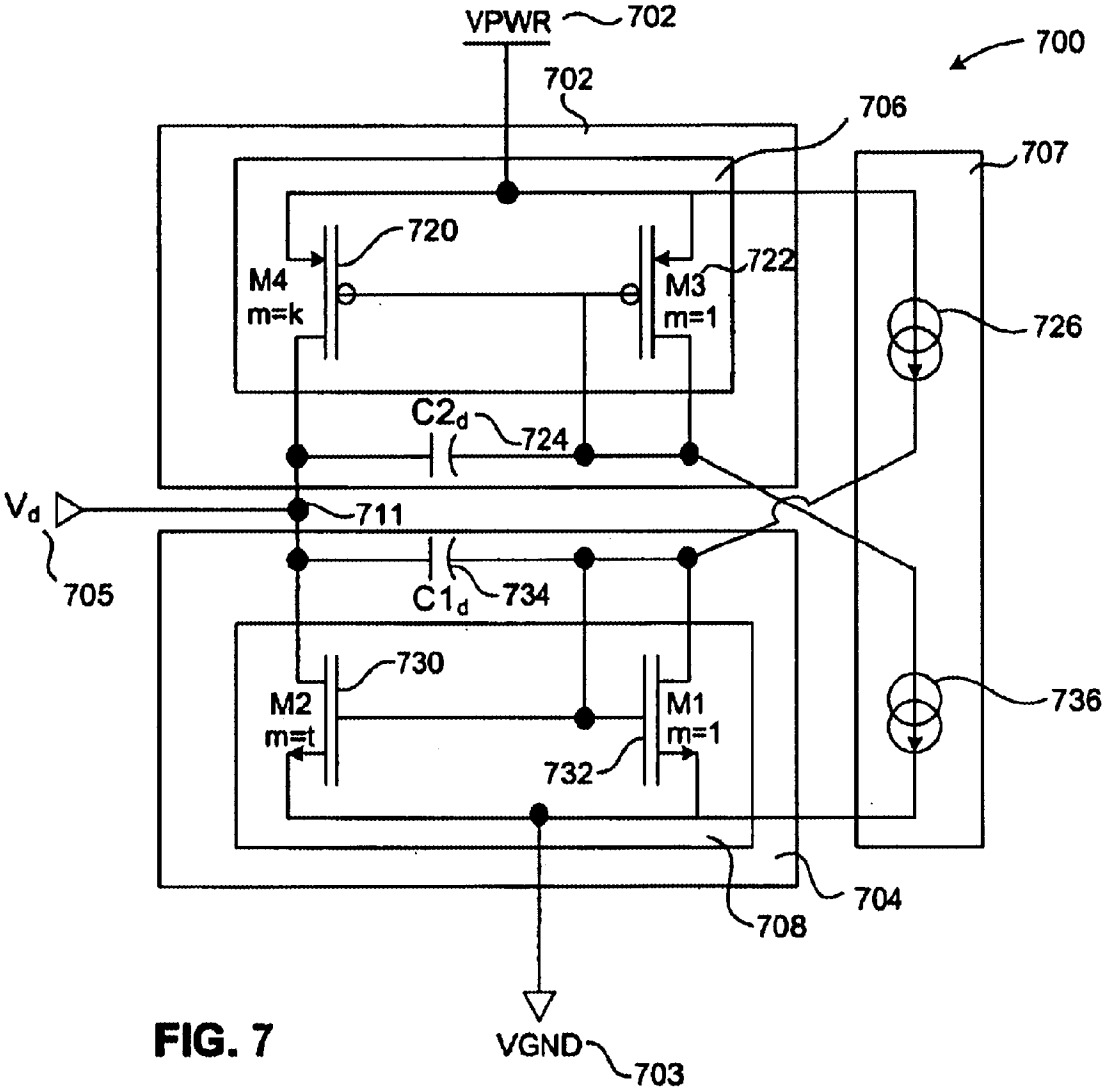
FIG. 7 schematically illustrates a decoupling circuit configured to decouple a signal having alternating polarities, according to one embodiment of the present invention.

FIG. 7 schematically illustrates another aspect of a decoupling circuit configured to decouple an input signal having alternating polarities, according to one embodiment of the present invention. In FIG. 7, decoupling circuit 700 includes a first component circuit 704, a second component circuit 702, and a bias network 707. The first component circuit 704 includes a first current mirror 708 and a first capacitor $C1_d$ 734. The second component circuit 702 includes a second current mirror 706 and a second capacitor $C2_d$ 724. In one embodiment, first capacitor $C1_d$ 734 has approximately equal capacitance to second capacitor $C2_d$ 724; other embodiments may use differing size capacitors depending on the amount of capacitance effect desired for decoupling the input signal $V_d$ 705 at each polarity. First current mirror 708 is biased by current source 726 in bias network 707, and by the fourth transistor M4 720 in the second mirror current mirror 706. Second current mirror 706 is biased by current source 736 in bias network 707, and by power source 702.

Each current mirror 708 and 706 is configured to amplify a current at the input of respective capacitors 734 and 724 by a predetermined amount using the negative feedback loop technique as described in reference to FIGS. 2–4. In one embodiment, current mirror 708 is configured to operate as a current mirror in a first polarity, and—at a threshold current—as a diode in a second polarity opposite to the first polarity. In this embodiment, current mirror 706 is configured to operate—at a threshold current—as a diode in the first polarity, and as a current mirror in the second polarity. Up to a threshold current, both current mirrors 706–708 operate in a complementary manner to decouple input signal $V_d$ 705.

In operation, as the voltage of input signal $V_d$ 705 goes up, the voltage at the gate of M2 goes up thereby causing current to flow through M2 730. Increased current flow through M2 730 tends to pull the input signal $V_d$ 705 down. In addition, the voltage at the gate of M4 goes up thereby causing current flow through M4 720 to decrease, thereby assisting the pull down effect of M2 730 on input signal $V_d$ 705. As the voltage of input signal signal $V_d$ 705 goes down, transistor M2 730 and M4 720 operate in an analogous, but opposite manner. This behavior is generated in one embodiment by implementing the first current mirror 708 with n-channel MOSFET transistors, and the second current mirror 706 with p-channel MOSFET transistors. In particular, the voltage at the gate of M4 goes up thereby causing current flow through M4 720 to increase, thereby pulling up input signal $V_d$ 705. The current through the gate to M2 goes down thereby causing the voltage at the gate of M2 730 to decrease. Decreased current flow through M2 730 assists M4 720 is pulling down input signal $V_d$ 705.

At a threshold voltage for input signal $V_d$ 705 (and depending on the polarity), either transistor M2 730 and M4 720 will turn off. In particular, current flow through the fourth transistor M4 720 (and the third transistor 722) is cut off when the input signal $V_d$ 705 has a positive polarity and the excursion is large enough to cause less than a threshold voltage drop from source to gate. Likewise, current flow through the second transistor M2 730 (and the first transistor 732) is cut off when the input signal $V_d$ 705 has a negative polarity and the excursion is large enough to cause less than a threshold voltage drop from gate to source.

The above description is provided to illustrate specific embodiments of the present invention and is not intended to be limiting. Numerous variations and modifications within the scope of the present invention are possible. For example, persons of ordinary skill in the art using the teachings of the present invention may transpose the order of the disclosed processing steps, interpose insignificant steps, or substitute materials equivalent to those disclosed herein. Thus, the present invention is limited only by the following claims.

What is claimed is:

1. A decoupling circuit, comprising:

a first capacitor;

a first current mirror coupled to the first capacitor, wherein the first current mirror is configured to multiply a capacitance effect of the first capacitor;

a second capacitor; and a second current mirror coupled to the second capacitor, wherein the second current mirror is configured to multiply a capacitance effect of the second capacitor.

2. The circuit of claim 1, wherein the first current mirror comprises:

a first transistor; and a second transistor coupled to the first transistor, such that a current flowing through the first transistor is a multiple of a current flowing through the second transistor.

3. The circuit of claim 2, wherein the first transistor and the second transistor comprise n-channel MOSFET transistors.

4. The circuit of claim 1, further comprising:

a bias network coupled to the first current mirror, wherein the bias network is configured to bias the first current mirror.

5. The circuit of claim 4, wherein the bias network comprises a p-channel MOSFET transistor.

6. The circuit of claim 1, wherein the first current mirror comprises a n-channel MOSFET, and the second current mirror comprises a p-channel MOSFET.

7. The circuit of claim 1, further comprising:

an input node connected to the first current mirror and the first capacitor and to the second current mirror and the second capacitor, the input node being configured to receive an input signal in a first polarity and a second polarity opposite to the first polarity, wherein:

the first current mirror and the first capacitor are configured to decouple the input signal in the first polarity; and the second current mirror and the second capacitor are configured to decouple the input signal in the second polarity.

8. The circuit of claim 7, wherein:

the first current mirror comprises a first MOSFET transistor; and the second current mirror comprises a second MOSFET transistor, the second MOSFET transistor having an opposite polarity to the first MOSFET transistor.

9. The circuit of claim 7, wherein:

the first current mirror comprises an n-channel MOSFET transistor; and the second current mirror comprises a p-channel MOSFET transistor.

10. A method of decoupling an input signal, the method comprising:

receiving an input signal on an input node connected to a first capacitor, the input signal alternating between a first polarity and a second polarity, the first polarity being opposite to the second polarity;

multiplying a capacitance effect of the first capacitor with a first current mirror;

multiplying a capacitance effect of a second capacitor with a second current mirror;

decoupling the input signal in the first polarity with the first capacitor and the first current mirror; and decoupling the input signal in the second polarity with the second capacitor and the second current mirror.

11. The method of claim 10, wherein the multiplying further comprises:

amplifying a current on the input node so that the input signal does not see a DC load at the input node.

12. The method of claim 11, wherein the amplifying further comprises:

implementing a negative feedback loop between the first capacitor and the first current mirror.

13. The method of claim 10, further comprising:

implementing a negative feedback loop between the second capacitor and the second current mirror.

14. The method of claim 10, further comprising:

connecting the first current mirror as a diode to the input signal when the input signal is in the first polarity; and connecting the second current mirror as a diode to the input signal when the input signal is in the second polarity.

15. A decoupling circuit, comprising:

a first capacitor;

a first current mirror coupled to the capacitor, the first current mirror being configured to multiply a capacitance effect of the first capacitor, the first current mirror comprising:

a first transistor; and a second transistor coupled to the first transistor, such that a current flowing through the first transistor is a multiple of a current flowing through the second transistor, and wherein the first transistor and the second transistor comprise n-channel MOSFET transistors.

16. A decoupling circuit, comprising:

a first capacitor;

a first current mirror coupled to the capacitor, wherein the first current mirror is configured to multiply a capacitance effect of the first capacitor;

a bias network coupled to the first current mirror, the bias network being configured to bias the first current mirror, and wherein the bias network comprises a p-channel MOSFET transistor.

* * * * *